US008890639B2

(12) United States Patent
Choi

(10) Patent No.: US 8,890,639 B2
(45) Date of Patent: Nov. 18, 2014

(54) AUXILIARY CONTACT MECHANISM FOR MAGNETIC CONTACTOR

(71) Applicant: LSIS Co., Ltd., Anyang-si, Gyeonggi-do (KR)

(72) Inventor: Gwan Ho Choi, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 173 days.

(21) Appl. No.: 13/711,506

(22) Filed: Dec. 11, 2012

(65) Prior Publication Data

US 2013/0154775 A1 Jun. 20, 2013

(30) Foreign Application Priority Data

Dec. 20, 2011 (KR) ..... 10-2011-0138573

(51) Int. Cl.

| | |
|---|---|
| ***H01H 9/00*** | (2006.01) |
| ***H01H 3/00*** | (2006.01) |
| ***H01H 51/22*** | (2006.01) |
| ***H01H 36/00*** | (2006.01) |

(52) U.S. Cl.

CPC ..... *H01H 36/00* (2013.01); *H01H 51/2209* (2013.01)

USPC ..... 335/179; 335/107; 335/132; 335/133; 335/177; 335/186; 335/189; 335/192

(58) Field of Classification Search

CPC ..... H01H 71/32

USPC ..... 335/107, 132, 133, 177, 179, 186, 189, 335/192

See application file for complete search history.

(56) References Cited

U.S. PATENT DOCUMENTS 2,506,991 A * 5/1950 Brown ..... 218/23
2,540,185 A * 2/1951 Brown ..... 335/156

(Continued)

FOREIGN PATENT DOCUMENTS

CH 404767 12/1965
CN 1753127 3/2006

(Continued)

OTHER PUBLICATIONS

Korean Intellectual Property Office Application Serial No. 10-2011-0138573, Notice of Allowance dated Oct. 31, 2012, 2 pages.

(Continued)

*Primary Examiner* — Mohamad Musleh
(74) *Attorney, Agent, or Firm* — Lee, Hong, Degerman, Kang & Waimey

(57) ABSTRACT

An auxiliary contact mechanism of a magnetic contactor includes: a contact support member having an axial recess portion formed in the center in a vertical direction; a stationary contact; a movable contact; a permanent magnet position-fixed to the contact support member and applying magnetic attractive force to restrain the movable contact so that the circuit closing position that the movable contact is in contact with the stationary contact is maintained; and a slide movable supporter having a pressing projection portion formed at a position separated apart by a predetermined distance from the movable contact when in the circuit closing position and pushing the movable contact to release the movable contact from a restrained state after a predetermined delay time has passed, when the slide movable supporter is moved downwardly upon receiving downward pressing force by the main contact slide support member.

6 Claims, 4 Drawing Sheets

(56) References Cited

U.S. PATENT DOCUMENTS

| | | | | |
|---|---|---|---|---|
| 3,296,567 | A * | 1/1967 | Conner et al. | 335/126 |
| 3,480,892 | A * | 11/1969 | Horii | 335/132 |
| 2006/0208591 | A1 | 9/2006 | Lee | |
| 2008/0238594 | A1 | 10/2008 | Liu et al. | |

FOREIGN PATENT DOCUMENTS

| | | |
|---|---|---|
| EP | 0483591 | 5/1992 |
| JP | 49-23763 | 2/1974 |
| JP | 50-13971 | 2/1975 |
| JP | 52-45167 | 3/1977 |
| JP | 55-124145 | 9/1980 |
| JP | 2001-520798 | 10/2001 |
| JP | 2005-276460 | 10/2005 |
| KR | 20-0376475 | 3/2005 |

OTHER PUBLICATIONS

Japan Patent Office Application Serial No. 2012-275743, Office Action dated Oct. 22, 2013, 2 pages.

European Patent Office Application Serial No. 12196332.6, Search Report dated Mar. 22, 2013, 6 pages.

The State Intellectual Property Office of the People's Republic of China Application Serial No. 201210558671.0, Office Action dated Sep. 3, 2014, 6 pages.

* cited by examiner

AUXILIARY CONTACT MECHANISM FOR MAGNETIC CONTACTOR

CROSS-REFERENCE TO RELATED APPLICATION

Pursuant to 35 U.S.C. §119(a), this application claims the benefit of earlier filing date and right of priority to Korean Application No. 10-2011-0138573, filed on Dec. 20, 2011, the contents of which is incorporated by reference herein in its entirety.

BACKGROUND OF THE INVENTION

1. Field of the Invention

The present disclosure relates to a magnetic contactor, and particularly, to an auxiliary contact mechanism that supplies electric power for magnetization to a magnetic coil for opening and closing a main contact in a magnetic contactor until immediately before the main contact is closed.

2. Background of the Invention

A magnetic contactor is a magnetic switch commonly used as a switch for supplying or cutting off electric power to generally run or stop control of an electric motor.

The magnetic contactor has the following operation principle. That is, according to magnetization of a magnetic coil, a stationary core accommodated within the magnetic coil attracts a moving core by magnetic force, and as the moving core is moved toward the stationary core according to the magnetic attraction, a movable contact supporting rod called a cross bar made of an electrical insulating material coupled to the moving core is moved together toward the stationary core and a movable contact comes into contact with a corresponding stationary contact to form a closing state such that a circuit is electrically connected Such a magnetic contactor may include a main contact mechanism having a closing position (or ON position) in which the electric power is applied to an electrical load such as a motor and an opening position (or an OFF position) in which electric power supply to the electrical load is cut off, and an auxiliary contact mechanism configured as a normally close contact which supplies electric power to a magnetic coil of the main contact mechanism or cuts off electric power supply to the magnetic coil of the main contact mechanism.

An example of the related art with respect to the magnetic contactor will be described with reference to FIGS. 1 to 3 as follows.

As can be seen from FIG. 1, a magnetic contactor according to an example of the related art may be a magnetic contactor in which an auxiliary contact mechanism according to an embodiment of the present invention may be installed to be used instead of an auxiliary contact mechanism of the related art. The magnetic contactor according to an example of the related art will be described commonly with reference to the present invention.

As can be seen from FIG. 1, the magnetic contactor 100 according to an example of the related art includes a main contact mechanism and an auxiliary contact mechanism 30.

The main contact mechanism includes a main contact slide support member 10 and a magnetic coil 20.

The main contact slide support member 10 is a supporting member which may be coupled with a main movable contact, among a main stationary contact and a main movable contact having main contacts, that is, contacts, and slidably movable in a vertical direction together.

A vertical guide recess portion (not shown) may be provided on a side wall of an outer case (not shown) of the magnetic contactor 100 in order to guide and support a side wall portion of the main contact slide support member 10 such that it is slidably movable.

An auxiliary contact pressing portion 10*a* is integrally provided with the main contact slide support member 10 and extends from the main contact slide support member 10 toward the auxiliary contact mechanism 30.

The auxiliary contact pressing portion 10*a* is a portion of the main contact slide support member 10 which is lifted and lowered according to a vertical movement of the main contact slide supporting member 10 to a position in which it presses the auxiliary contact mechanism 30 or to a position in which it is apart from the auxiliary contact mechanism 30.

The magnetic coil 20 is configured as an electromagnet, that is, as a coil magnetized when an electric current flows on the magnetic coil 20. The magnetic coil 20 is installed in the vicinity of a stationary core (not shown) to form a magnetic coil assembly.

A movable core (not shown) may be provided in a position opposite an upper portion of the stationary core, and the corresponding movable core may be coupled to the main contact slide supporting member 10 and moved in a direction such that it approaches the stationary core or in a vertical direction such that it is apart from the stationary core.

In FIG. 1, reference numeral 40 denotes a coil assembly accommodation case as an outer case which accommodates the magnetic coil assembly of the main contact mechanism and the auxiliary contact mechanism 30.

A support wall portion (not shown) may be provided on an inner side wall of the coil assembly accommodation case 40 in order to support a contact support member 31 of the auxiliary contact mechanism 30 as described hereafter such that a position thereof is fixed.

Meanwhile, a detailed configuration and operation of the auxiliary contact mechanism 30 of the magnetic contactor according to an example of the related art will be described with reference to FIGS. 2 and 3.

The auxiliary contact mechanism 30 of the magnetic contactor according to an example of the related art includes a contact support member 31, a slide movable supporter 32, a stationary contact 33, a movable contact 34, an auxiliary contact spring 35, and a return spring 36.

The contact support member 31 provides a means for supporting the stationary contacts 33 among the auxiliary contact mechanism 30, and has an axial recess portion 31*a* formed extendedly at the inner side in a vertical direction from an upper surface to a blocked bottom surface to allow the slide movable supporter 32 to be vertically movable.

The contact support member 31 may be made of an artificial resin insulating material having electrical insulating characteristics, and may be fixedly supported by a support wall portion (not shown) provided in an inner side wall of the coil assembly accommodation case 40 of FIG. 1.

The slide movable supporter 32 is a means slidably lifted or lowered in a vertical direction through the axial recess portion 31*a* of the contact support member 31, and coupled to the movable contact 34 such that the movable contact 34 is inserted into a central portion and supported.

Each of the stationary contacts 33 is configured as an electrical conductor thin plate member formed to have an "L" shape, and includes a terminal portion protruded to be exposed from outer side of an upper portion of the contact support member 31 and a contact portion extending to the inner side of the contact support member 31 and having a contact in an end portion.

The stationary contacts 33 are configured as a pair and supported in the contact support member 31. One stationary contact 33 may be electrically connected with an external control electric power line (not shown) to open or close the magnetic contactor 100, and the other stationary contact 33 may be electrically connected with the magnetic coil 20 of the main contact mechanism.

The movable contact 34 may be configured as an electrical conductor thin plate member formed to have a shape of about a straight line shape and includes a support portion inserted to pass through a central portion of the slide movable supporter 32 and contact portions provided in both end portions of the movable contact 34 such that they face the contact portion of the stationary contact 33 and being movable in a vertical direction to a position in which the contact portion is in contact with the contact portion of the stationary contact 33 or separated from the contact portion of the stationary contact 33.

The auxiliary contact spring 35 is supported between a bottom surface of a central portion of the movable contact 34 and a spring support protrusion portion provided to be protruded upwardly from a lower portion of the slide movable supporter 32, and provides elastic force pressing toward the stationary contact 33 to the movable contact 34.

The return spring 36 is supported between a lower end portion of the slide movable supporter 32 and the spring support protrusion portion formed to be protruded upwardly from a bottom surface of the contact support member 31, and provides elastic force to the slide movable supporter 32 to move upwardly.

The operation of the auxiliary contact mechanism 30 of the magnetic contactor according to an example of the related art configured as described above will be described with reference to FIGS. 2 and 3.

An operation of the magnetic contactor to a circuit closing position (or an ON position) will be described.

When control electric power is supplied from the external control electric power line (not shown), the electric current flows between both stationary contacts 33 in a state that the movable contact 34 is in contact with the both stationary contacts 33 in the state of FIG. 2, and thus, the current from the control electric power flows to the magnetic coil 20 of FIG. 1.

Thus, the magnetic coil 20 is magnetized to attract the movable core (not shown) and the main contact slide support member 10 downwardly, so that a circuit closing position operation is executed that the movable contact (not shown) coupled to the main contact slide support member 10 comes into contact with a lower stationary contact (not shown).

Thus, the auxiliary contact pressing portion 10*a* integrally connected with the main contact slide support member 10 is lowered together with the main contact slide support member 10 to pressurize an upper end portion of the slide movable supporter 32 downwardly as shown in FIG. 3.

Thus, the slide movable supporter 32 and the movable contact 34 overcome elastic force of the auxiliary contact spring 35 and the return spring 36 and are moved together downwardly. At this time, the slide movable supporter 32 is slidably lowered through the axial recess portion 31*a* of the contact support member 31 as a lifting or lowering passage.

Thus, the movable contact 34 of the auxiliary contact mechanism 30 is separated from both stationary contacts 33, and thus, the supply of control electric power supplied to the main contact mechanism through the auxiliary contact mechanism 30 is cut off.

A circuit opening position (or an OFF position) of the magnetic contactor will be described.

When the supply of control electric power from the external control electric power line (not shown) is stopped, that is, when a control signal through the control electric power line is not provided, even though the movable contact 34 comes into contact with the both stationary contact 33 in the state illustrate in FIG. 2, there is no current from the control electric power flowing to the magnetic coil 20 in FIG. 1 because there is no current flowing through the both stationary contacts 33.

Thus, the magnetic coil 20 is demagnetized and magnetic attractive force attracting the movable core (not shown) and the main contact slide support member 10 downwardly disappears, and as the main contact slide support member 10 is moved upwardly by elastic force of the return spring (not shown), the movable contact (not shown) coupled to the main contact slide member 10 is separated from the lower stationary contact (not shown), thus performing a circuit opening position operation.

Thus, the auxiliary contact pressing portion 10*a* integrally connected with the main contact slide support member 10 is lifted together with the main contact slide support member 10, and pressure pressing an upper end portion of the slide movable supporter 32 downwardly disappears.

Thus, the slide movable supporter 32 and the movable contact 34 are moved upwardly together by elastic force of the auxiliary contact spring 35 and the return spring 36. At this time, the slide movable supporter 32 is slidably lifted through the axial recess portion 31*a* of the contact support member 31 as a lifting or lowering passage.

Thus, the movable contact 34 of the auxiliary contact mechanism 30 comes into contact with the both stationary contacts 33, and thus, next supply of control electric power toward the main contact mechanism through the auxiliary contact mechanism 30 is waited.

However, in the auxiliary contact mechanism of the magnetic contactor according to the related art configured and operated as described above, as soon as the auxiliary contact pressing portion 10*a* integrally connected with the main contact slide support member 10 pressurizes the slide movable supporter 32 of the auxiliary contact mechanism 30 downwardly, the movable contact 34 of the auxiliary contact mechanism 30 is separated from both stationary contacts 33. Thus, electric power supply to the main contact mechanism is stopped before an operation of the main contact mechanism to the circuit closing position (or ON position) is not completed, and thus, there is a problem of occurrence of the phenomenon that the operation of the main contact mechanism to the circuit closing position (or ON position) is not completed.

SUMMARY OF THE INVENTION

Therefore, an aspect of the present disclosure is to provide an auxiliary contact mechanism of a magnetic contactor in which a circuit closing position of the auxiliary contact mechanism is maintained until when an operation of a main contact mechanism to a circuit closing position is completed and, when the operation of the main contact mechanism to the circuit closing position is completed, the auxiliary contact mechanism performs a circuit opening operation immediately.

To achieve these and other advantages and in accordance with the purpose of this disclosure, as embodied and broadly described herein, for a magnetic contactor having a main contact slide support member supporting a main contact and being slidably movable in a vertical direction, an auxiliary contact mechanism for the magnetic contactor comprising:

a contact support member made of an electrical insulating material that supports a contact and has an axial recess portion formed at the center of the contact support member in a vertical direction with a blocked lower portion;

a stationary contact position-fixedly supported by the contact support member;

a movable contact having a circuit closing position in which the movable contact is in contact with the stationary contact and being movable to a circuit opening position in which the movable contact is separated from the stationary contact;

a permanent magnet position-fixed to the contact support member and applying magnetic attractive force to restrain the movable contact so that the circuit closing position that the movable contact is in contact with the stationary contact is maintained; and a slide movable supporter coupled to the movable contact so as to be movable in a vertical direction in the axial recess portion together with the movable contact, being slidably movable together with the movable contact to make the movable contact be moved to the circuit opening position when pressing force acting downwardly by the main contact slide support member is received, and having a pressing projection portion formed at a position separated apart by a predetermined distance from the movable contact when in the circuit closing position and pushing the movable contact to release the movable contact from a restrained state after a predetermined delay time has passed, when the slide movable supporter is moved downwardly upon receiving downward pressing force by the main contact slide support member According to an aspect of the present invention, the auxiliary contact mechanism of a magnetic contactor further comprising:

an auxiliary opening spring that has one end portion supported by the slide movable supporter and the other end portion supported by the movable contact and provides elastic force to the movable contact in a direction in which the movable contact is separated from the stationary contact.

According to another aspect of the present invention, an upper end portion of the slide movable supporter has a large diameter portion having a diameter larger than a bore of the axial recess portion.

According to still another aspect of the present invention, the auxiliary contact mechanism of a magnetic contactor may further comprising:

a return spring having an upper end portion supported by a lower end portion of the slide movable supporter and a lower end portion supported by the contact support member within the axial recess portion, and that elastically pressurizes the slide movable supporter to be returned to the circuit closing position when the pressing force acting downwardly disappears.

According to yet another aspect of the present invention, movable contact is configured by a leaf spring.

According to another aspect of the present invention, slide movable supporter comprises:

a body portion movable vertically within the axial recess portion of the contact support member;

a spring accommodation protrusion portion that is formed to extend downwardly from the body portion and supports the auxiliary opening spring; and a stopper step portion that is formed to limit a movement of the movable contact to the circuit opening position at a lower position of the spring accommodation protrusion portion.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this disclosure, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 4:
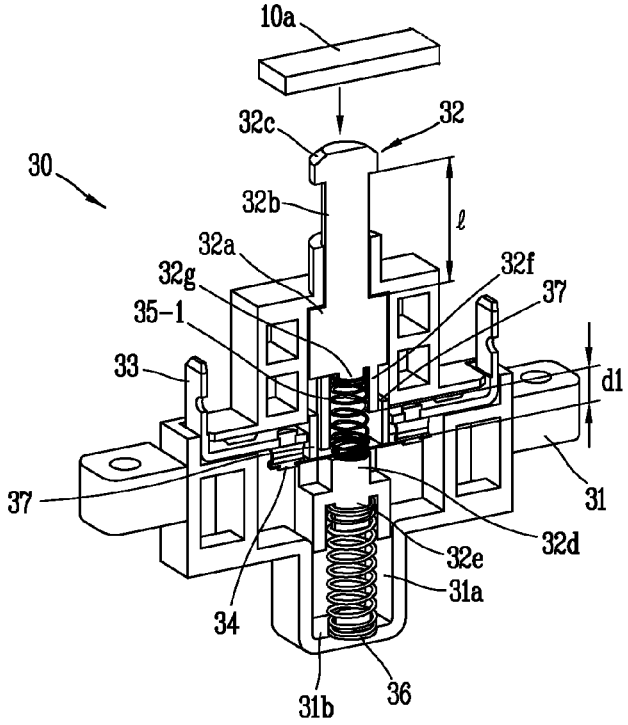
FIG. 4 is a perspective view showing a configuration of an auxiliary contact mechanism of a magnetic contactor according to a preferred embodiment of the present invention and showing an operation state of the auxiliary contact mechanism in the circuit closing position.
Figure 5:
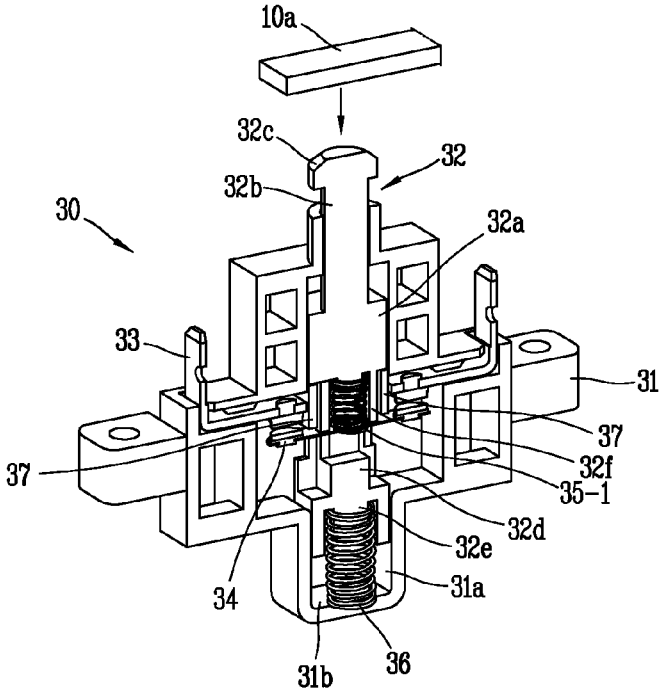
FIG. 5 is a perspective view showing a configuration and an operation of the auxiliary contact mechanism in an initial state of a circuit opening position in the auxiliary contact mechanism of a magnetic contactor according to a preferred embodiment of the present invention.
Figure 6:
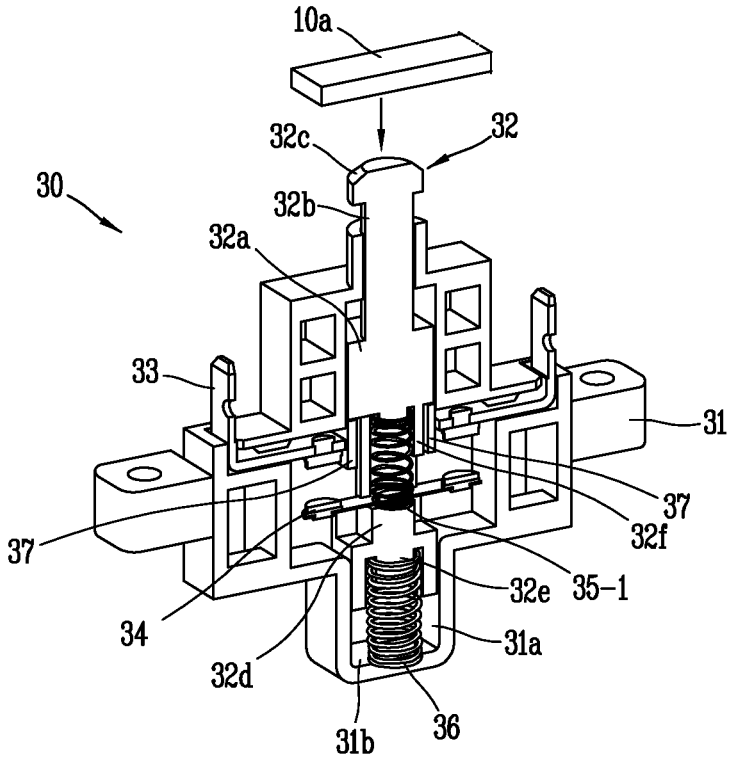
FIG. 6 is a perspective view showing a configuration and an operation of the auxiliary contact mechanism in a complete state of the circuit opening position in the auxiliary contact mechanism of a magnetic contactor according to a preferred embodiment of the present invention

An object of the present invention and a configuration for achieving the object, and an operational effect of the present invention may be clearly understood by a following description of an auxiliary contact mechanism of a magnetic contactor according to a preferred embodiment of the present invention and an operational effect with reference to FIGS. 4 to 6.

Figure 1:
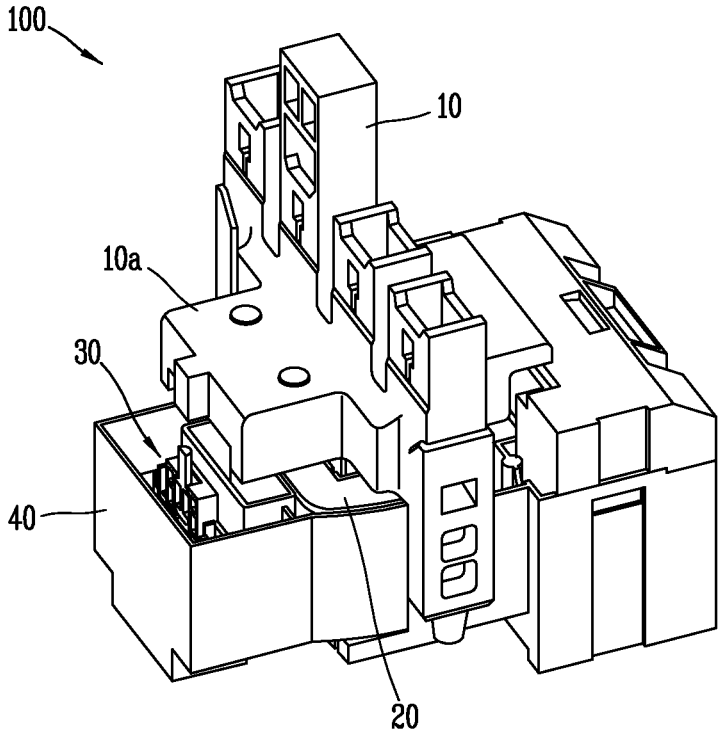
FIG. 1 RELATED ART
FIG. 1 is a perspective view showing a main configuration of a magnetic contactor according to an example of a related art.

An auxiliary contact mechanism according to an embodiment of the present invention may be installed in a magnetic contactor as described in the related art with reference to FIG. 1, and used.

As illustrated in FIG. 1 and as described above, a magnetic contactor 100 has a main contact slide support member 10 supporting a main contact and being slidably movable in a vertical direction. Also, as can be seen from FIGS. 5 and 6, the magnetic contactor 100 may include an auxiliary contact pressing portion 10*a* as a portion of the main contact slide support member 10 which is lifted or lowered according to a vertical movement of the main contact slide support member 10 to a position in which the auxiliary contact pressing portion 10*a* pressurizes an auxiliary contact mechanism 30 or to a position in which the auxiliary contact pressing portion 10*a* becomes apart from the auxiliary contact mechanism 30.

Meanwhile, a configuration of the auxiliary contact mechanism according to a preferred embodiment of the present invention that may be installed in the magnetic contactor 100 and used as described above will be described with reference to FIG. 4.

The auxiliary contact mechanism 30 according to a preferred embodiment of the present invention is configured to include a contact support member 31, a stationary contacts 33, a movable contact 34, a permanent magnet 37, and a slide movable supporter 32.

The contact support member 31 may be a member made of an electrical insulating material and supporting a contact, in other words, the stationary contacts 33. The contact support member 31 includes an axial recess portion 31*a* formed at the center in a vertical direction and having a blocked lower portion.

The stationary contacts 33 are the contacts position-fixedly supported by the contact support member 31. The stationary contacts 33 are configured by a pair of contacts and each of the contacts 33 have a contact attached to one end portion (the end portion positioned within the contact support member 31). The other end portion (the end portion positioned to be exposed to the outside of the contact support member 31) of each of the stationary contacts 33 is connected to an external electric line. One of the pair of stationary contacts 33 may be electrically connected to an electric power source that generates a control signal for magnetization control of the magnetic contactor and the other one of the pair of stationary contacts 33 may be electrically connected to a magnetic coil 20 of the main contact mechanism with reference to FIG. 1 in the magnetic contactor.

The movable contact 34 is a normal closed contact having a circuit closing position in contact with the stationary contact 33 normally and being movable to a circuit opening position in which the movable contact 34 is separated from the stationary contact 33.

In order for the movable contact 34 to be restrained in a position by magnetic flux from the permanent magnet 37, a body portion having a straight line shape, excluding the contact, of the movable contact 34 may be made of an iron material according a preferred embodiment of the present invention.

According to a preferred one aspect of the present invention, the movable contact 34 is configured as a leaf spring such that contact pressure in contact with the stationary contact 33 is reinforced by elastic force.

The permanent magnet 37 is position-fixed in a predetermined position of the contact support member 31. According to a preferred embodiment of the present invention, a corresponding fixed position is a position between a pair of stationary contacts 33 in the contact support member 31.

In order for the movable contact 34 to maintain a circuit closing position in contact with the stationary contact 33, the permanent magnet 37 applies magnetic attractive force by magnetic flux restraining the movable contact 34.

The slide movable supporter 32 is a member made of an electrical insulating material having generally an shaft shape. The slide movable supporter 32 is a member movable in a vertical direction within the axial recess portion 31*a* of the contact support member 31.

When the slide movable supporter 32 receives pressure downwardly acting by the main contact slide support member (See reference numeral 10 in FIG. 1), the slide movable supporter 32 may be slidably moved within the axial recess portion 31*a* together with the movable contact 34 such that the movable contact 34 is moved to a circuit opening position.

Also, the slide movable supporter 32 includes a pressing projection portion 32*f* in order to push the movable contact 34 to release from a restrained state by the permanent magnet 37 after a predetermined delay time has lapsed when the slide movable supporter 32 is moved downwardly by receiving pressure applied downwardly by the main contact slide support member. To this end, the pressing projection portion 32*f* has a position separated apart by a predetermined distance (See reference numeral d1 in FIG. 4) from the movable contact 34 when in the circuit closing position.

According to a preferred one aspect of the present invention, an upper end portion of the slide movable supporter 32 has a large diameter portion 32*c* having a diameter larger than a bore of the axial recess portion 31*a*.

According to a preferred one aspect of the present invention, the auxiliary contact mechanism 30 further includes an auxiliary opening spring 35-1 having one end portion supported by the slide movable supporter 32 and the other end portion supported by the movable contact 34 and applying elastic force to the movable contact 34 in a direction the movable contact 34 is separated from the stationary contact 33.

According to a preferred one aspect of the present invention, the slide movable supporter 32 includes a body portion 32*a*, a neck portion 32*b*, a spring accommodation protrusion portion 32*g*, and a stopper step portion 32*d*.

The body portion 32*a* is a middle portion of the side movable supporter 32 having about a quadrangular vertically-sectional shape and is movable vertically within the axial recess portion 31*a*.

The neck portion 32*b* is a portion formed between the body portion 32*a* and the large diameter portion 32*c* and having a width shorter and longer than the body portion 32*a* and the large diameter portion 32*c*. A length (See reference character I in FIG. 4) of the neck portion 32*b* is longer than a distance d1 between the pressing projection portion 32*f* and the movable contact 34 in an initial state of FIG. 4, and may be determined in consideration of an operation length (stroke) of the slide movable supporter 32.

The spring accommodation protrusion portion 32*g* is a protrusion portion formed to extend downwardly from the body portion 32*a*, and is inserted into the auxiliary open spring 35-1 to support one end portion (upper end portion) of the auxiliary open spring 35-1.

The stopper step portion 32*d* is formed to limit a movement of the movable contact 34 to a circuit opening position under the spring accommodation protrusion portion 32*g*. In detail, the stopper step portion 32*d* is a portion formed to be protruded in a right angle direction to an extending direction of the auxiliary opening spring 35-1 under the spring accommodation protrusion portion 32*g* and to stop the movable contact 34 moving downwardly as a circuit opening direction while separating from the stationary contact 33.

According to a preferred one aspect of the present invention, the auxiliary contact mechanism 30 further includes the return spring 36.

The return spring 36 is a spring having an upper end portion supported by a lower end portion of the slide movable supporter 32 and a lower end portion supported by a bottom portion 31*b* of the contact support member 31 within the axial recess portion 31*a*.

In more detail, a spring seat portion 32*e* is formed to be protruded downwardly from the slide movable supporter 32 to insert into the inner side of the return spring 36, and a spring seat portion is also provided on the bottom portion 31*b* of the contact support member 31 and inserted into the return spring 36, and thus, the return spring 36 is supported by the corresponding spring seat portions.

When external force applied downwardly to the slide movable supporter 32 by the main contact slide support member disappears, the return spring 36 elastically pressurizes the slide movable supporter 32 to be returned to the circuit closing position.

As described above, an operation of the auxiliary contact mechanism 30 according to an embodiment of the present invention will be described mainly with reference to FIGS. 4 to 6 and secondarily with reference to FIG. 1.

An operation to a circuit closing position (or ON position) of the magnetic contactor will be described.

When control electric power is supplied from the external control electric power source line (not shown), a current flows between the both stationary contacts 33 in a state that the movable contact 34 is in contact with the both stationary contacts 33 in the state of FIG. 4, and thus, the current from the control electric power source flows to the magnetic coil 20 of FIG. 1.

Thus, the magnetic coil 320 is magnetized to attract downwardly the movable core (not shown) and the main contact slide support member 10 and the movable contact (not shown) coupled to the main contact slide support member 10 comes into contact with the lower stationary contact (not shown), thus performing a circuit closing position operation.

Thus, the auxiliary contact pressing portion 10*a* integrally connected to the main contact slide support member 10 is lowered together with the main contact slide support member 10 to downwardly pressurize the large diameter portion 32*c* of the slide movable supporter 32 as illustrated in FIG. 5.

Then, the slide movable supporter 32 and the movable contact 34 overcome elastic force of the return spring 36 and are moved together downwardly. At this time, the slide movable supporter 32 is slidably lowered through the axial recess portion 31*a* of the contact support member 32 as a lifting or lowering passage.

At this time, different from the related art, in the auxiliary contact mechanism 30 according to an embodiment of the present invention, the movable contact 34 is not separated from the both stationary contacts 33 immediately when the slide movable supporter 32 is lowered. That is, the movable contact 34 is maintained in contact with the both stationary contacts 33, and when the pressing projection portion 32*f* of the slide movable supporter 32 separated by a predetermined distance (See reference numeral d1 in FIG. 4) from the movable contact 34 pressurizes the movable contact 34, the movable contact 34 starts to be separated from the both stationary contacts 33 by overcoming magnetic force for maintaining contact of the permanent magnet 37 as shown in FIG. 5.

In other words, by an initial time during which the slide movable supporter 32 is moved downwardly by the predetermined distance d1 between the pressing projection portion 32*f* and the movable contact 34, a time is delayed after the slide movable supporter 32 starts to be lowered and the movable contact 34 of the auxiliary contact mechanism 30 according to an embodiment of the present invention is separated from the both stationary contacts 33.

Thus, different from the related art, the auxiliary contact mechanism 30 according to a preferred embodiment of the present invention can supply a magnetizing current for a closing operation to the magnetic coil 20 of the main contact mechanism to thus stably complete the closing (ON position) operation of the magnetic contactor. Also, after the circuit closing operation, the current supplied to the magnetic coil 20 of the main contact mechanism is cut off to obtain an effect of preventing damage to the magnetic coil 20.

Thereafter, as shown in FIG. 6, the movable contact 34 is completely separated from the both stationary contacts 33 instantly according to application of elastic force according to stretching of the auxiliary opening spring 35-1, and thus, the supply of control electric power supplied to the main contact mechanism through the auxiliary contact mechanism 30 is cut off.

An operation of the magnetic contactor to a circuit opening position (OFF position) will be described.

Figure 2:
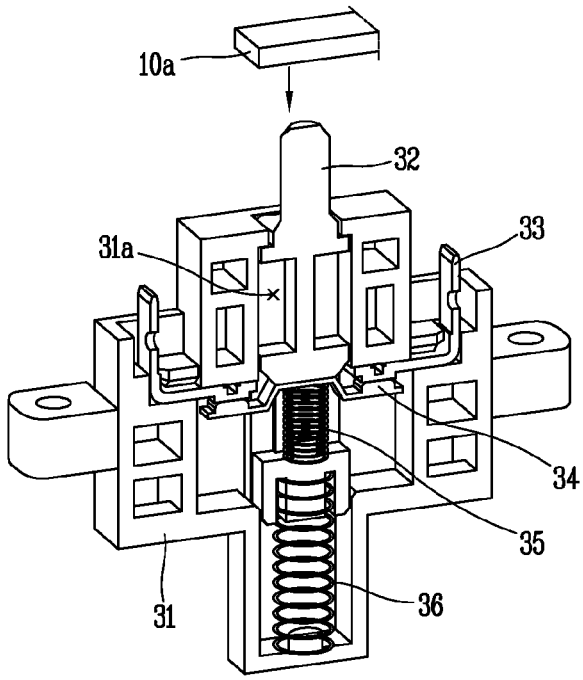
FIG. 2 RELATED ART
FIG. 2 is a perspective view showing a configuration of an auxiliary contact mechanism of the magnetic contactor according to an example of a related art, and showing a state of an auxiliary contact mechanism when in a circuit closing position.
Figure 3:
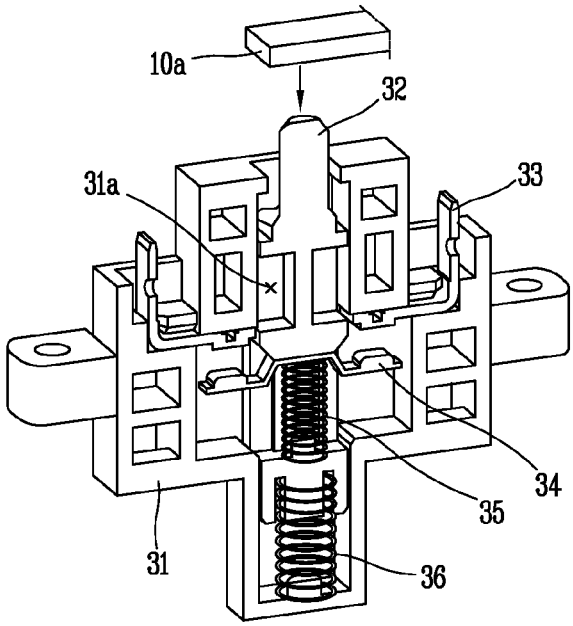
FIG. 3 RELATED ART
FIG. 3 is a perspective view showing a state of the auxiliary contact mechanism when in a circuit opening position in the auxiliary contact mechanism of the magnetic contactor according to an example of the related art.

When supply of control electric power from the external control electric power line is stopped, that is, when there is no control signal through the control electric power line, even though the movable contact 34 comes into contact with the both stationary contacts 33 in the state of FIG. 2, there is no current from the control electric power source flowing to the magnetic coil 20 in FIG. 1 because there is no current flowing through the both stationary contacts 33.

Thus, the magnetic coil 20 is demagnetized and the magnetic attractive force attracting the movable core (not shown) and the main contact slide support member 10 downwardly disappears and the main contact side support member 10 is moved upwardly by elastic force of the return spring (not shown), and thus, the movable contact (not shown) coupled to the main contact slide support member 10 is separated from the lower stationary contact (not shown), thus performing the circuit closing position operation.

Thus, the auxiliary contact pressing portion 10*a* integrally connected to the main contact slide support member 10 is also lifted together with the main contact slide support member 10, and thus, pressure pressurizing an upper end portion of the slide movable supporter 32 downwardly disappears.

Thus, the slide movable supporter 32 and the movable contact 34 are moved upwardly together with the elastic force of the return spring 36. At this time, the slide movable supporter 32 is slidably lifted through the axial recess portion 31*a* of the contact support member 31 as the lifting or lowering passage. Thus, the movable contact 34 of the auxiliary contact mechanism 30 comes into contact with the both stationary contacts 33, and thus, next supply of control electric power to the main contact mechanism through the auxiliary contact mechanism 30 is on standby.

The auxiliary contact mechanism 30 of the magnetic contactor according to an embodiment of the present invention further includes an auxiliary opening spring 35-1 applying elastic force to the movable contact 34 in a direction the movable contact 34 is separated from the stationary contact 33. Thus, when the operation of the main contact mechanism to the circuit closing position is completed, elastic force can be provided immediately such that the auxiliary contact mechanism performs the opening operation.

In the auxiliary contact mechanism 30 according to an embodiment of the present invention, an upper end portion of the slide movable supporter 32 has the large diameter portion 32*c* having a diameter larger than the bore of the axial recess portion of the contact support member, so an introduction of a foreign material through the axial recess portion 31*a* can be prevented and a lowered movement of the slide movable supporter 32 in a vertical direction can be limited.

Because the auxiliary contact mechanism 30 according to an embodiment of the present invention further includes the return spring elastically pressurizing the slide movable supporter 32 to be returned to the circuit closing position when pressure of the auxiliary contact pressing portion 10*a* applied downwardly disappears, when downward pressing force by the main contact slide support member of the main contact mechanism disappears, the movable contact 34 of the auxiliary contact mechanism 30 can be returned to the initial position in which the movable contact 34 is in contact with the stationary contact 33.

In the auxiliary contact mechanism 30 according to an embodiment of the present invention, because the movable contact 34 is configured as a leaf spring, an effect of strengthening a contact force by the elastic force of the movable contact when the movable contact is in contact with the stationary contact 33 can be obtained.

In the auxiliary contact mechanism 30 according to an embodiment of the present invention, because the stopper step portion 32*d* formed to limit the movement of the movable contact 34 to the circuit opening position under the spring accommodation protrusion portion (32*g*) is further included, in case of the circuit opening position operation, the stopper protrusion steep portion 32*s* limits the movement of the movable contact to the circuit opening position, and thus, when the movable contact 34 operates to the circuit closing position in which the movable contact 34 is in contact with the stationary contact 33 later, the operation can be quickly performed.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. For a magnetic contactor having a main contact slide support member supporting a main contact and being slidably movable in a vertical direction, an auxiliary contact mechanism for the magnetic contactor comprising:

a contact support member made of an electrical insulating material that supports a contact and has an axial recess portion formed at the center of the contact support member in a vertical direction with a blocked lower portion;

a stationary contact position-fixedly supported by the contact support to member;

a movable contact having a circuit closing position in which the movable contact is in contact with the stationary contact and being movable to a circuit opening position in which the movable contact is separated from the stationary contact;

a permanent magnet position-fixed to the contact support member and applying magnetic attractive force to restrain the movable contact so that the circuit closing position that the movable contact is in contact with the stationary contact is maintained; and a slide movable supporter coupled to the movable contact so as to be movable in a vertical direction in the axial recess portion together with the movable contact, being slidably movable together with the movable contact to make the movable contact be moved to the circuit opening position when pressing force acting downwardly by the main contact slide support member is received, and having a pressing projection portion formed at a position separated apart by a predetermined distance from the movable contact when in the circuit closing position and pushing the movable contact to release the movable contact from a restrained state after a predetermined delay time has passed, when the slide movable supporter is moved downwardly upon receiving downward pressing force by the main contact slide support member.

2. The auxiliary contact mechanism according to claim 1, further comprising:

an auxiliary opening spring that has one end portion supported by the slide movable supporter and the other end portion supported by the movable contact and provides elastic force to the movable contact in a direction in which the movable contact is separated from the stationary contact.

3. The auxiliary contact mechanism according to claim 1, wherein an upper end portion of the slide movable supporter has a large diameter portion having a diameter larger than a bore of the axial recess portion.

4. The auxiliary contact mechanism according to claim 1, further comprising:

a return spring having an upper end portion supported by a lower end portion of the slide movable supporter and a lower end portion supported by the contact support member within the axial recess portion, and that elastically pressurizes the slide movable supporter to be returned to the circuit closing position when the pressing force acting downwardly disappears.

5. The auxiliary contact mechanism according to claim 1, wherein the movable contact is configured by a leaf spring.

6. The auxiliary contact mechanism according to claim 2, wherein slide movable supporter comprises:

a body portion movable vertically within the axial recess portion of the contact support member;

a spring accommodation protrusion portion that is formed to extend downwardly from the body portion and supports the auxiliary opening spring; and a stopper step portion that is formed to limit a movement of the movable contact to the circuit opening position under the spring accommodation protrusion portion.

* * * * *